US007527100B2

(12) United States Patent
Abadie

(10) Patent No.: US 7,527,100 B2
(45) Date of Patent: May 5, 2009

(54) METHOD AND APPARATUS FOR CUTTING AND REMOVAL OF PIPE FROM WELLS

(76) Inventor: Chad Abadie, 3906 Highway 90 East, Broussard, LA (US) 70501

( * ) Notice: Subject to any disclaimer, the term of this patent is extended or adjusted under 35 U.S.C. 154(b) by 193 days.

(21) Appl. No.: 11/647,782

(22) Filed: Dec. 29, 2006

(65) Prior Publication Data

US 2008/0156494 A1 Jul. 3, 2008

(51) Int. Cl.
*E21B 43/11* (2006.01)

(52) U.S. Cl. ..... 166/298

(58) Field of Classification Search ..... 166/298, 166/55.7; 175/52, 85
See application file for complete search history.

(56) References Cited

U.S. PATENT DOCUMENTS

| | | | | |
|---|---|---|---|---|
| 3,782,459 | A | 1/1974 | Murray | |
| 3,983,936 | A | 10/1976 | Kennard et al. | |
| 4,047,568 | A | 9/1977 | Aulenbacher | |
| 4,550,781 | A | 11/1985 | Kagler, Jr. | |
| 4,969,514 | A | 11/1990 | Morris et al. | |
| 5,211,251 | A * | 5/1993 | Woolslayer | 175/85 |
| 5,253,710 | A | 10/1993 | Carter et al. | |
| 5,318,115 | A | 6/1994 | Rouse | |
| 6,029,745 | A | 2/2000 | Broussard et al. | |
| 6,357,528 | B1 | 3/2002 | Davis et al. | |
| 6,629,565 | B2 | 10/2003 | Harrell | |
| 6,827,145 | B2 | 12/2004 | Fotland et al. | |
| 2002/0162657 | A1 | 11/2002 | Tumlin et al. | |
| 2003/0056953 | A1 | 3/2003 | Tumlin et al. | |
| 2005/0082063 | A1 | 4/2005 | Fotland et al. | |
| 2005/0145389 | A1 | 7/2005 | Barrow et al. | |
| 2005/0173123 | A1 | 8/2005 | Lund et al. | |

OTHER PUBLICATIONS

"The Cutting Edge of P&A Technology"; Undated Brochure Developed by applicant's employer; circulated after Jan. 2006.

* cited by examiner

*Primary Examiner*—William P Neuder
(74) *Attorney, Agent, or Firm*—Ted M. Anthony

(57) ABSTRACT

A method and apparatus for down hole cutting of pipe, such as casing and other tubular goods, and plugging and abandonment of wells, without the need for a drilling or work over rig. An adjustable stand is provided for supporting and stabilizing a power swivel, and for axially positioning the power swivel relative to a well to be abandoned. An optional work deck is also provided to allow personnel to access the well. The adjustable stand and work deck of the present invention can be easily adapted to a wide range of working environments.

16 Claims, 5 Drawing Sheets

METHOD AND APPARATUS FOR CUTTING AND REMOVAL OF PIPE FROM WELLS

CROSS REFERENCES TO RELATED APPLICATIONS

None

STATEMENTS AS TO RIGHTS TO INVENTIONS MADE UNDER FEDERALLY SPONSORED RESEARCH AND DEVELOPMENT

None

BACKGROUND OF THE INVENTION

1. Field of the Invention

The present invention pertains to a method and apparatus for plugging and abandoning wells, such as oil and/or gas wells. More particularly, the present invention pertains to a method and apparatus for mechanically cutting and removing tubular goods including, but not limited to, casing from wells without requiring use of a drilling rig, workover rig or other similar equipment.

2. Description of the Prior Art

Wells, such as oil and gas wells, are typically drilled using drilling rigs or other similar systems. In most cases, drilling rigs are used to drill substantially cylindrical boreholes downward into the earth's crust. Once a well has been drilled to a desired depth, large diameter pipe commonly referred to as casing is thereafter installed into a well and cemented in place. Casing is typically installed to provide structural integrity to a borehole and to keep geologic formations (as well as any fluids contained therein) isolated from one another.

In many cases, a single well can have multiple strings of casing. In such cases, a first casing string having a relatively large inner diameter and corresponding outer diameter is driven into the earth's crust. Thereafter, a length of borehole is drilled from said first casing string. A second, smaller casing string is concentrically installed within said first casing string and bore hole and cemented in place. This process can be repeated until a well is drilled to a predetermined depth and a desired length of casing is installed in such well. In most cases, once a well is drilled to its desired depth, production tubing is concentrically installed within the innermost casing string, and surface equipment is erected.

It is frequently challenging and expensive to plug and abandon wells after hydrocarbon reserves in such wells have been depleted. Generally, surface equipment and production tubing must first be removed from a well. Thereafter, as much casing as possible is typically retrieved from the well; in many cases, such casing can be reused in other wells or sold for salvage. However, because the casing (or large portions thereof) is typically cemented in place, blades or other cutting devices are frequently required to cut the casing at a desired depth in the well.

After desired cut(s) are made, the casing is typically pulled out of the well from the surface. However, due to the weight of the pipe, as well as frictional forces acting on such pipe, it is often difficult to pull the casing out of the well. Accordingly, pulling equipment, such as hoists, jacks or the like, are often required to pull the casing out of a well.

Drilling rigs and smaller work-over rigs are frequently used to plug and abandon wells. A rig's rotary equipment can be utilized to actuate blades and/or other cutting equipment in order to make down-hole cuts in a casing string. Further, a rig's derrick and draw works can also be used to pull casing from a well. However, drilling rigs, which are typically leased to well owners on a daily basis, can be expensive to use for abandonment operations. Moreover, drilling rigs can also be difficult and expensive to mobilize, especially when such rigs are intended to work on offshore wells drilled from platforms or other marine structures.

Systems have been developed for plugging and abandoning wells without the use of a drilling or workover rig. However, existing "rig-less" tubular removal systems have some significant shortcomings.

Existing rig-less tubular removal systems generally utilize a power swivel that is supported over a well bore. In such cases, the power swivel is used to rotate a string of pipe at the surface that, in turn, causes blades or other cutting devices to rotate downhole. A crane is typically utilized to support axial loading on the power swivel, while a snub line or "dead man" is typically used to offset radial loading on the power swivel.

With existing rig-less tubular removal systems, power swivels are frequently not adequately supported or stabilized. As a result, power swivels can often move and sway radically during operation. When a power swivel sways at the surface, such movement is frequently transferred down hole to blades or other cutting devices within a well bore. Such movement can cause the blades or other cutting devices to change positions within a well bore which, in turn, can change the depth at which casing or other tubular goods are cut.

Even if a power-swivel is not moving or swaying radically at the surface, existing systems permit downhole travel of cutting blades. When a power swivel is not firmly supported and secured, as is frequently the case with existing tubular removal systems, the position of downhole cutting blades can change over time. This results in longer cutting times and, frequently, increased damage to downhole blades. Further, when multiple strings of casing are cut in extended reach applications having large diametric variance, downhole cutting operations become extremely difficult, if not impossible, using existing tubular removal systems.

Ultimately, such lack of support and stability of a power swivel affects the depth at which tubulars are cut which, in turn, impacts the amount of tubulars that can be recovered from a well. If a cut is made too shallow, excess pipe can be left in a well. Alternatively, if a cut is made too deep, the length of pipe to be pulled out of the well can be greater than anticipated and can exceed the load capacity of a crane or other hoisting means.

Significant time and effort is required to rig up and rig down existing rig-less tubular removal systems. With such existing systems, a power swivel must generally be rigged down and rigged back up between each cut, even on multi-well platforms or other marine structures. Rigging up of a power swivel typically requires connecting a hydraulic power pack (engine and pumps) to the swivel head of the power swivel using a number of different hoses. Thereafter, the power swivel is typically picked up with one line of a crane, while another line of a crane is used to "snub off" the power swivel to some fixed point on the platform utilizing a torque arm or dead man connected to the swivel head. Rigging down the power swivel entails the same basic process in reverse order, except that the power swivel must be stored in an alternate location during such operation.

Existing rig-less tubular removal systems also give rise to safety concerns. One such safety concern results from repeated stretching and relaxing of crane cables during cutting operations. Such loading can cause the cables to fatigue, thereby making such cables more susceptible to breaking. For example, if a snub line breaks, the power swivel can spin and bounce wildly. If this occurs, connecting hoses will typically break, spewing hydraulic oil and/or other fluids around the work site and surrounding environment.

Additionally, if downhole cutting blades become lodged, or if the cut casing or tubulars fall onto the blades, a crane is typically unable to pull such blades free. Even if the blades can be pulled free, the power swivel will frequently bounce upward at the surface in response to such blades coming free. Under either scenario, personnel in the vicinity of the operation are placed at risk.

Thus, there is a need for a method and apparatus for mechanically plugging and abandoning wells, especially wells drilled from offshore platforms or other marine structures, that is safer and more effective than existing systems.

SUMMARY OF THE INVENTION

The present invention comprises a method and apparatus for mechanical cutting and removal of tubular goods, such as casing, from wells, including oil and/or gas wells. Specifically, the present invention comprises a method and apparatus for mechanically cutting single or multiple casing strings (or other tubular goods) down hole. Following a cut, the present invention permits removal of a portion of such casing or other tubular goods from a well. The present invention does not require the use of a drilling or workover rig.

In the preferred embodiment, the present invention comprises an adjustable stand that is used to support a power swivel at a desired point above a well to be plugged and abandoned. The height of the stand and, thus the power swivel supported by such stand, can be raised or lowered using hydraulic power, pneumatic power, or the like. The adjustable stand is utilized to support a power swivel that, in turn, is utilized to rotate blades or other cutting devices down hole within a well to be abandoned.

The adjustable power swivel stand of the present invention is slidably mounted on a work deck that is capable of accepting the stand without impeding the area above a well bore. Such work deck provides a supportive platform for personnel to access the work area above and in the general vicinity of a well to be abandoned. In the preferred embodiment, a crane pole is also incorporated on such work deck in order to selectively position power tongs in and out of the work area such as, for example, to make and break threaded pipe connections.

The adjustable power swivel stand of the present invention eliminates the need to utilize a crane to support a power swivel during cutting operations. As such, many of the aforementioned problems associated with use of a crane to support and stabilize power swivels are eliminated. In most cases, in accordance with the method and apparatus of the present invention, it is not necessary to utilize a crane until after a downhole cut is completed, or when blades or other cutting devices must be changed.

In the preferred embodiment of the present invention, instead of supporting a power swivel, a crane can be used to make up and install a bottom hole assembly, as well as any associated tubular work string that is used to convey such bottom hole assembly into a well prior to cutting operations. After cutting operations are complete, a crane can also be used to remove such bottom hole assembly and tubular work string from the well.

The adjustable power swivel stand of the present invention can also be used to fine-tune the depth of downhole blades or other cutting devices in order to improve the overall quality and efficiency of such cuts. By permitting fine tuning of the depth of the downhole blades or other cutting device, an operator can beneficially vary the torque required to make a particular cut, thereby improving the performance of such blades or other cutting devices.

The present invention provides great flexibility, since it can be configured to fit particular surface requirements dictated by specific job locations. Such surface requirements may include, but are not necessarily limited to, lack of surface area or footprint, or weakness or lack of surface structure.

The present invention permits the use of existing hydraulically-actuated single string or multi-string mechanical cutter devices, as well as down-hole stabilizers. In practice, at least one down-hole stabilizer is typically utilized to provide the maximum cutting efficiency.

DETAILED DESCRIPTION OF THE PRESENT INVENTION

Figure 1:
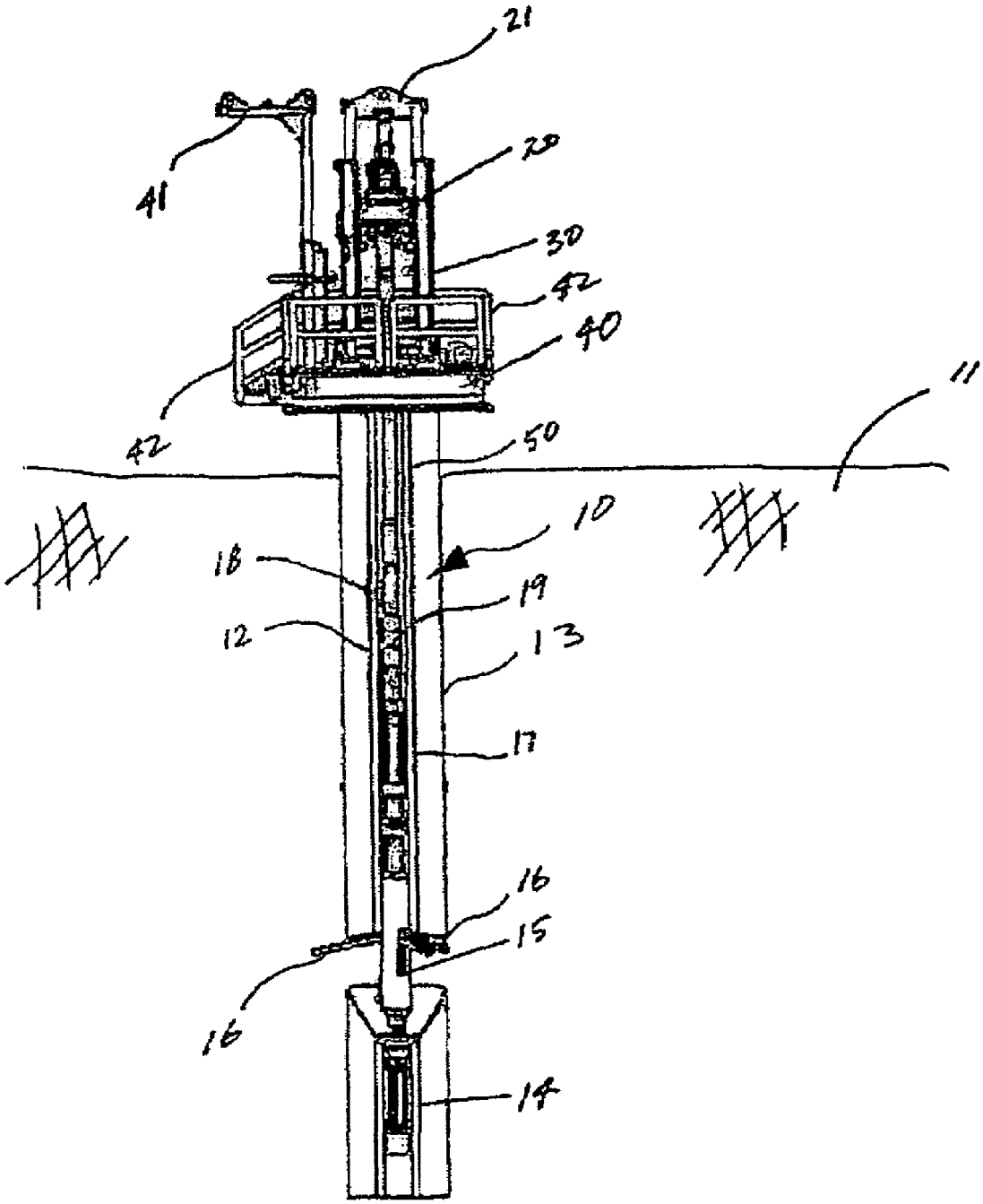
FIG. 1 depicts a side sectional view of the apparatus of the present invention making a downhole cut of tubulars in a well.

Referring to the drawings, FIG. 1 depicts a side sectional view of the plugging and abandonment apparatus of the present invention making a downhole cut of tubular goods in a well. Well 10, from which pipe such as casing and/or production tubing is to be removed, extends downward into earth's crust 11. Well 10 further comprises production tubing string 12 which is concentrically disposed within casing string 13. It is to be observed that, in many cases, casing string 13, or at least a portion thereof, is cemented in place within a bore hole drilled into earth's crust 11.

A bottom hole assembly is lowered into well 10. Although such bottom hole assembly can comprise any number of different beneficial tools or components, such bottom hole assembly is depicted in FIG. 1 as comprising at least one stabilizer 14 and a downhole cutting tool 15. In the preferred embodiment, cutting tool 15 includes a plurality of blades 16 that extend radially outward from said cutting tool 15. In addition to such components, in the preferred embodiment the bottom hole assembly can optionally include other beneficial components such as, for example, at least one non-rotating stabilizer 17, quick-catch sub 18 and cross-over sub 19.

Still referring to FIG. 1, power swivel 20 is beneficially mounted on adjustable power swivel stand 30, which is in turn disposed on work deck 40. In most applications, work deck 40 is positioned on or over a pre-existing structure (not shown in FIG. 1) used to support well 10 such as for example, an offshore platform, caisson or other similar structure.

Cutting tool 15 can be one of any number of different casing cutting tools known in the art. In FIG. 1, cutting tool 15 is depicted as a hydraulic casing cutter, which can be used to cut through multiple concentric strings of tubulars such as production tubing string 12 and casing string 13.

In operation, cutting tool 15 is lowered into well 10 until blades 16 are positioned at a desired depth where a cut is to be made. In the preferred embodiment, cutting tool 15 is conveyed into well 10 via a tubular workstring 50, which is itself comprised of a plurality of threaded pipe joints that are joined together.

Tubular work string 50 extends from the downhole bottom hole assembly to the surface of well 10, where it is received by power swivel 20. Power swivel 20 can be one of any number of different power swivel devices known in the art that can be used to spin or rotate pipe, such as tubular work string 50. In the preferred embodiment of the present invention, power swivel 20 is mounted on adjustable power swivel stand 30. Optional crane becket 21 can also be attached to power swivel 20 to provide a means for lifting such power swivel using a crane or other hoisting device.

Still referring to FIG. 1, optional rotating crane pole 41 can be disposed on the upper surface of work deck 40. Optional crane pole 41 can be utilized to support tongs or other beneficial tools that can be swiveled above well 10, then easily moved out the way when not needed. Optional hand rails 42 are also provided along the upper surface of work deck 40. In most cases, optional hand rails 42 extend along the outer perimeter of work deck 40 to provide a safety barrier for personnel working on such deck.

Actuation of power swivel 20 transfers torque to tubular workstring 50 which causes tubular workstring 50 to rotate. Such torque is, in turn, transferred down hole to cutting tool 15, resulting in rotation of cutting tool 15 and, more particularly, blades 16 of cutting tool 15 within well 10. Rotation of blades 16 permits tubing string 12 and/or casing string 13 to be cut, as desired. Lower stabilizer 14 and non-rotating stabilizer 17 serve to stabilize the cutting action of cutting tool 15.

Figure 2:
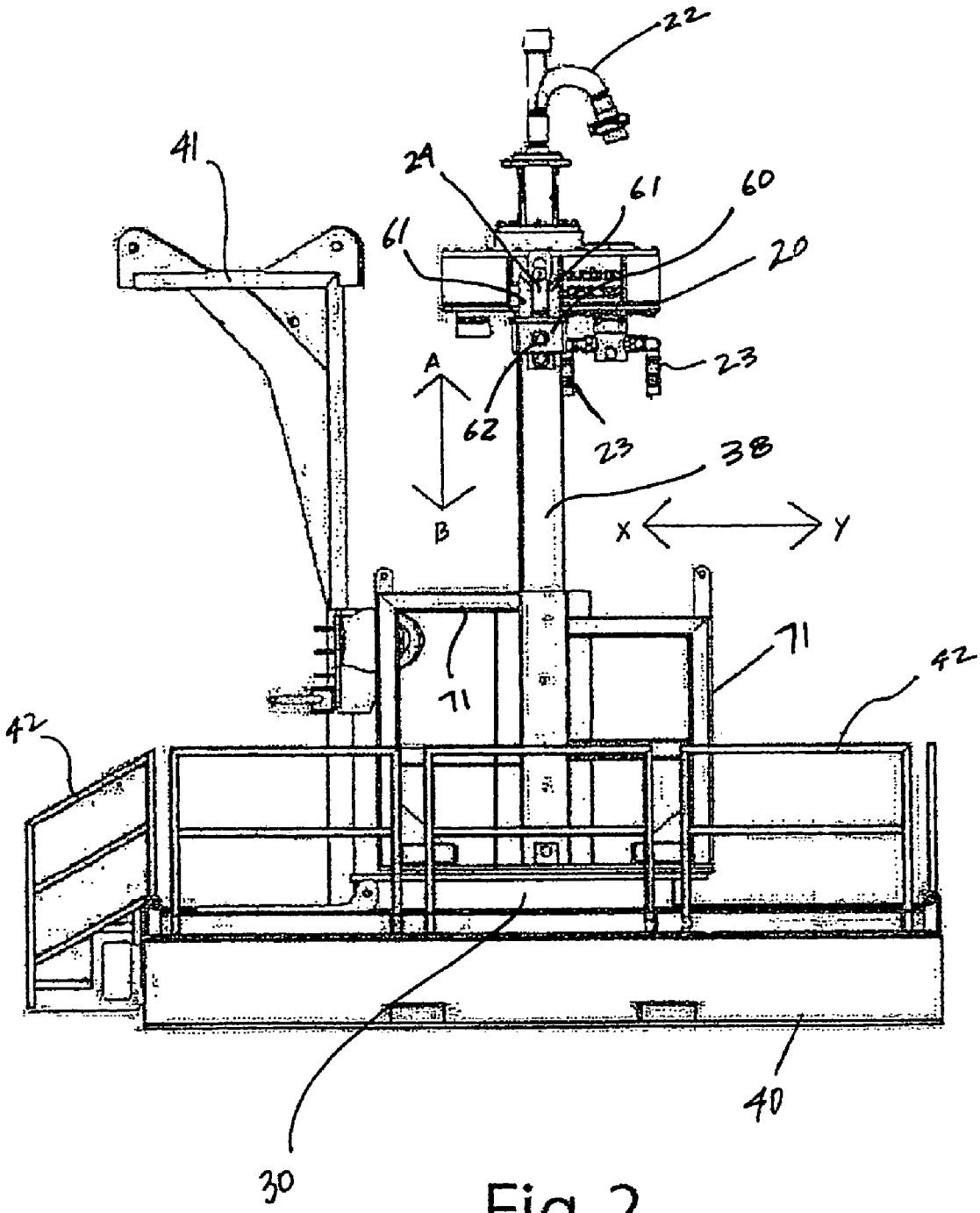
FIG. 2 depicts a side view of the apparatus of the present invention with a power swivel in a raised position.

FIG. 2 depicts a side view of the apparatus of the present invention with power swivel 20 in an extended or raised position. Adjustable power swivel stand 30 is mounted on the upper surface of work deck 40, while power swivel 20 is mounted on adjustable power swivel stand 30. Optional rotating crane pole 41 is disposed on the upper surface of work deck 40. Optional hand rails 42 are also disposed along the upper surface of work deck 40.

Power swivel 20 includes fluid connection line 22. Such fluid connection line 22, which is well known to those having skill in the art, allows fluid to be pumped through power swivel 20, into tubular workstring 50 and to any downhole tools(s) or bottom hole assembly attached to tubular workstring 50 (such as cutting tool 15). Hydraulic connection lines 23 can be connected to hoses (not shown in FIG. 2) that can be used to actuate power swivel 20 via a hydraulic power pack or other similar device known in the art.

As will be described in greater detail below, adjustable power swivel stand 30 permits vertical raising and lowering of power swivel 20. Further, adjustable power swivel stand 30 also permits horizontal movement of power swivel 20 relative to work deck 40 (and, accordingly, a well situated thereunder). Referring to FIG. 2, arrows A and B depict the vertical direction that power swivel 20 can travel using adjustable power swivel stand 30, while arrows X and Y depict the horizontal directions that power swivel 20 can travel using adjustable power swivel stand 30.

Still referring to FIG. 2, adjustable power swivel stand 30 includes support frame 71 and telescoping vertical support columns 38 (although only one such column is visible in the view depicted in FIG. 2). Telescoping vertical support column 38 can be extended or retracted, as desired, in the directions depicted by arrow A-B in FIG. 2. In the preferred embodiment of the present invention, a power swivel mounting bracket 60 is removably mounted at or near the upper extent of telescoping vertical support column 38 and pinned in place using pin 62. Said power swivel mounting bracket 60 includes mounting recess 61 for receiving a side mounting arm 24 of power swivel 20. In the preferred embodiment, side mounting arm 24 of power swivel 20 can be easily installed in, and removed from, mounting recess 61 of power swivel mounting bracket 60, thereby permitting efficient removal/replacement of power swivel 20.

Figure 3:
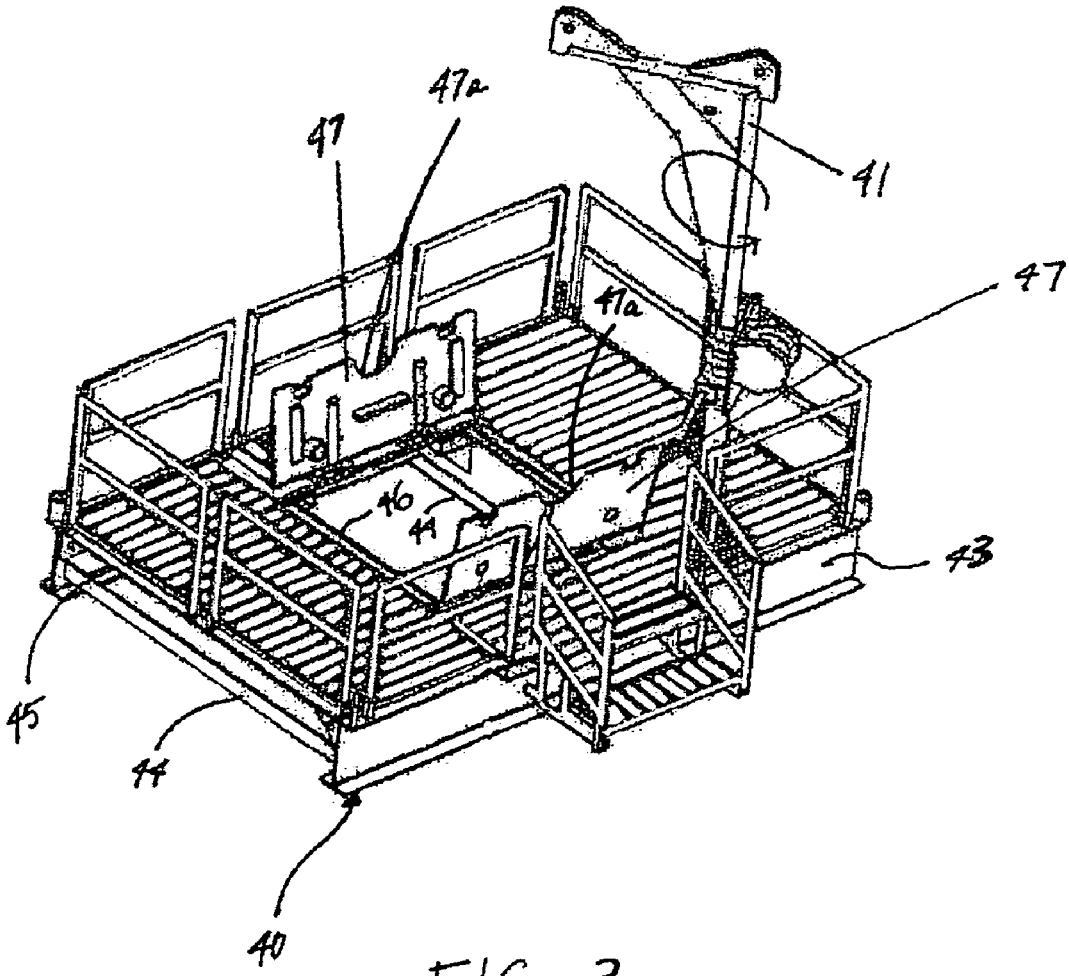
FIG. 3 depicts a perspective view of a work deck of the present invention with doors open to permit access below such deck.

FIG. 3 depicts a perspective view of work deck 40 of the present invention. Work deck 40 generally comprises side foundation members 43, as well as lower frame members 44. Grating 45 is mounted to said base and frame members to provide a substantially flat and horizontal work surface to support personnel and/or equipment. Rotating crane pole 41 is disposed on the upper surface of work deck 40, while optional hand rails 42 extend along the outer perimeter of work deck 40.

Opening 46 extends through work deck 40, and hinged access doors 47 are disposed over opening 46. In the preferred embodiment of the present invention, two hinged doors 47, each having aligned notches 47*a*, are mounted over opening 46. When open, hinged doors 47 provide access through substantially all of opening 46. When closed, said hinged doors 47 prevent access through opening 46, except that aligned notches 47*a* form an opening even when hinged doors 47 are closed over opening 46.

In the preferred embodiment, work deck 40 is beneficially mounted over a well (such as well 10) from which tubulars are to be removed. Specifically, opening 46 and, more particularly, aligned notches 47*a*, are placed directly over a well from which tubulars are to be recovered (such as well 10 depicted in FIG. 1). In this position, a tubular workstring such as workstring 50 can be used to convey tools or perform operations in well 10 below work deck 40 via the opening provided by aligned notches 47*a* even when hinged doors 47 are closed. However, if desired, hinged doors 47 can be opened to provide greater access to well 10 via opening 46. Such access can be critical to conducting operations on a well. For example, such access can be vital when lowering a bottom hole assembly into well 10, or when removing a bottom hole assembly from a well after a cut has been completed.

Figure 4:
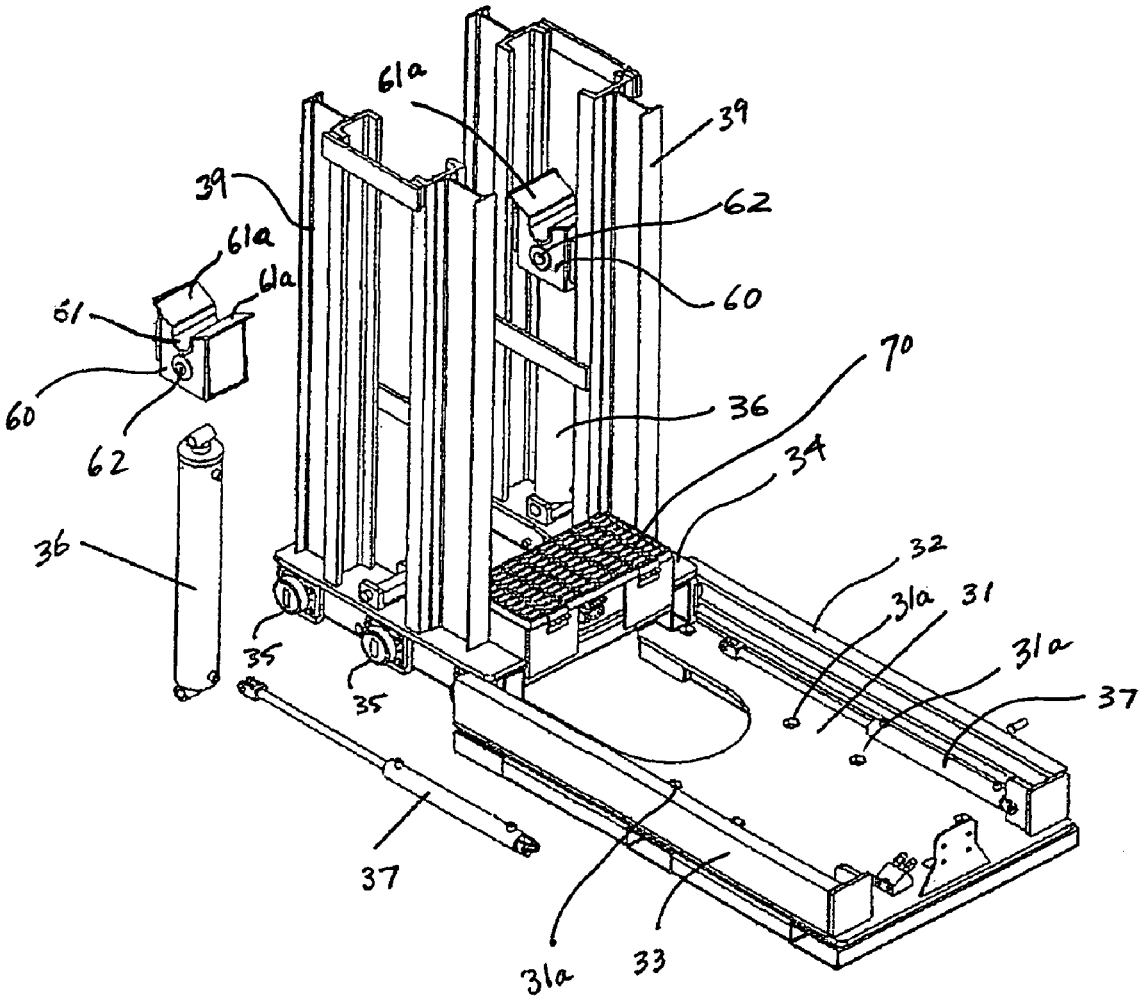
FIG. 4 depicts a partially exploded view of an adjustable hydraulic stand of the present invention.

FIG. 4 depicts a partially exploded and cut-away perspective view of adjustable power swivel stand 30 of the present invention. In the preferred embodiment, adjustable power swivel stand 30 is used to support and stabilize a power swivel, such as power swivel 20, and axially position such power swivel 20 relative to a well from which tubular goods are to be recovered (such as well 10 depicted in FIG. 1).

Referring to FIG. 4, adjustable power swivel stand 30 has substantially planar base 31. Substantially planar base 31 can be rigidly affixed to a work deck, such as work deck 40 (not shown in FIG. 4). Although substantially planar base 31 can be mounted to a work deck many different ways, a plurality of mounting holes 31*a* are provided in planar base 31 for this purpose. Parallel tracks 32 and 33 are disposed along opposite sides of substantially planar base 31 in a substantially horizontal orientation. Moveable power swivel support frame 34 is slidably disposed within tracks 32 and 33. Rollers 35 attached to power swivel support frame 34 help overcome frictional forces so that power swivel support frame 34 can freely travel along the length of tracks 32 and 33. Optional personnel support step 70 is also provided on power swivel support frame.

Still referring to FIG. 4, moveable power swivel support frame 34 includes substantially parallel upright frame members 39. In the preferred embodiment, telescoping vertical support columns 38 are disposed within substantially parallel upright frame members 39; however, the outer housing of said telescoping vertical support columns 38 is not depicted in FIG. 4 for illustration purposes. Further, rigid support frame 71 is typically mounted on movable power swivel support frame 34; however, rigid support frame 71 is not shown in the embodiment depicted in FIG. 4

Adjustable power swivel stand 30 also includes vertical hydraulic cylinders 36 and horizontal hydraulic cylinders 37. In the preferred embodiment, vertical hydraulic cylinders 36 are disposed within telescoping vertical support columns 38 (not shown in FIG. 4), which are in turn disposed on moveable power swivel support frame 34. Horizontal hydraulic cylinders 37 are disposed on or in the vicinity of tracks 32 and 33.

Each power swivel mounting bracket 60 includes a mounting recess 61 for receiving a side mounting arm of a power swivel (such as side mounting arms 24 of power swivel 20, not shown in FIG. 4). In the preferred embodiment, the upper surfaces 61*a* of each mounting bracket 60 are inwardly sloped toward mounting recesses 61 which helps to ensure that side mounting arms of a power swivel are fully engaged within said mounting recesses.

Horizontal hydraulic cylinders 37 are used to position moveable power swivel support frame 34 horizontally along tracks 32 and 33. More particularly, horizontal hydraulic cylinders 37 can be used to move a power swivel (supported on movable power swivel support frame 34) directly over a well, and out of the area above such well, in order to facilitate desired operations on such well.

Vertical hydraulic cylinders 36 are used to vertically position a power swivel mounted in power swivel support frame 34. Vertical hydraulic cylinders 36 can also be used to apply upward axial force to a power swivel mounted in power swivel support frame 34; such upward axial force can be transferred downhole, typically via a tubular workstring, in order to pull cutting blades that may become stuck in a well.

Figure 5:
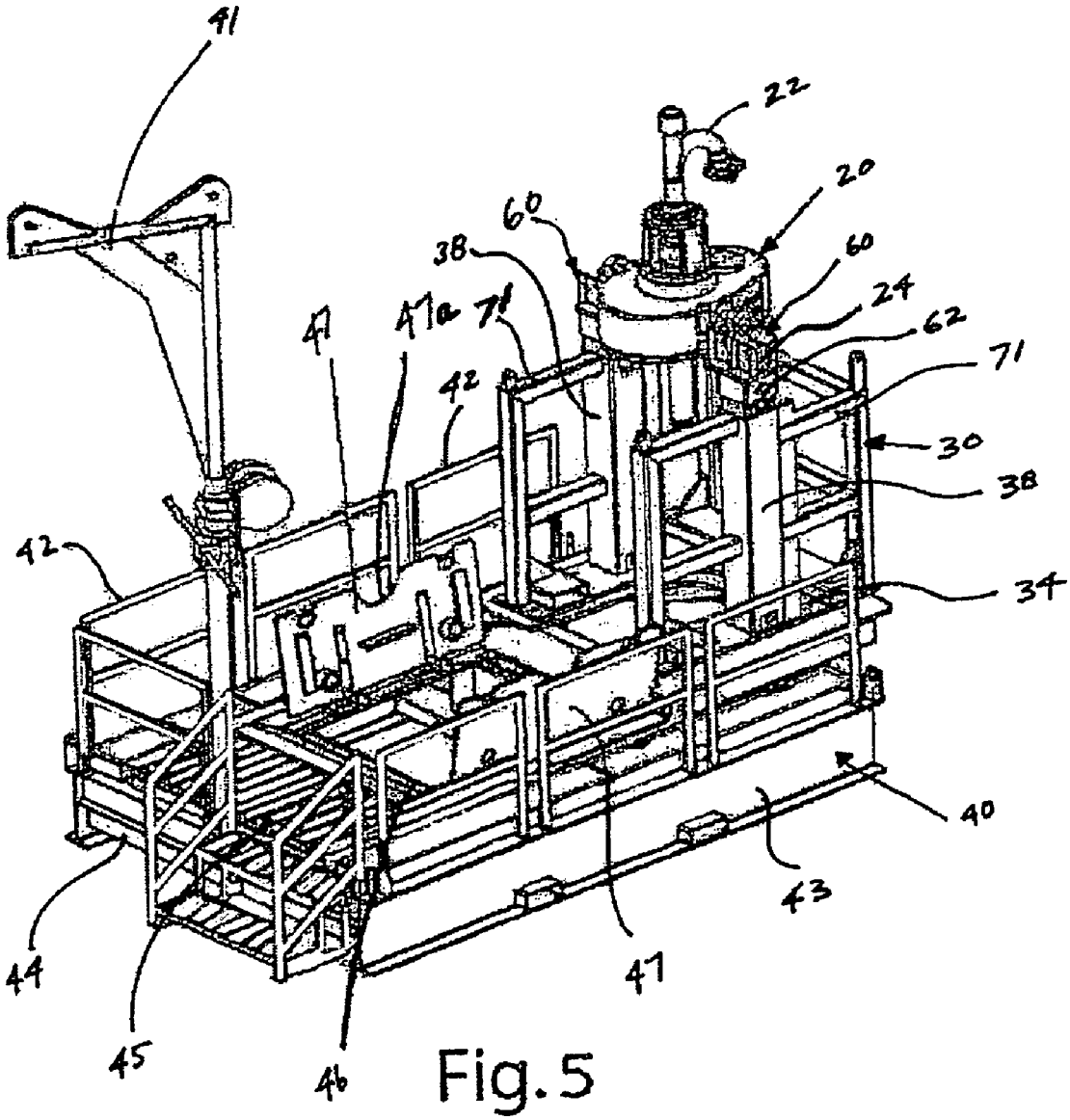
FIG. 5 depicts a perspective view of the apparatus of the present invention in a retracted position.

FIG. 5 depicts a perspective view of the apparatus of the present invention in a retracted position relative to a well. Although not depicted in FIG. 5, it is to be observed that a well, (such as well 10 depicted in FIG. 1), is located below and in general alignment with opening 46 in work deck 40.

Adjustable power swivel stand 30 is mounted on the upper surface of work deck 40, while power swivel 20 is mounted on adjustable power swivel stand 30. Optional rotating crane pole 41 is disposed on the upper surface of work deck 40. Optional hand rails 42 are also disposed along the upper surface of work deck 40. Work deck 40 generally comprises-side foundation members 43, as well as lower frame members 44. Grating 45 is mounted to said base and frame members to provide a substantially horizontal work surface to support personnel and/or equipment.

Adjustable power swivel stand 30 includes support frame 71 and telescoping vertical support columns 38. Although depicted in a retracted position, telescoping vertical support columns 38 can be vertically extended. Power swivel mounting brackets 60 are mounted at or near the upper extent of telescoping vertical support columns 38 and pinned in place using pin 62. Said power swivel mounting brackets 60 each receive a side mounting arm 24 of power swivel 20.

Opening 46 extends through work deck 40, while hinged access doors 47 having aligned notches 47*a* are disposed over opening 46. When hinged doors 47 are open, as depicted in FIG. 5, access to a well is provided through opening 46. When closed, said hinged doors 47 prevent access through opening 46 except through aligned notches 47*a*.

Adjustable power swivel stand 30 is mounted on work deck 40 and is used to support and stabilize a power swivel, such as power swivel 20, and axially position such power swivel 20 relative to a well from which tubular goods are to be recovered. Parallel tracks 32 and 33 of adjustable power swivel stand 30 (obscured from view in FIG. 5) are disposed in a substantially horizontal orientation relative to work deck 40. Moveable power swivel support frame 34 is slidably disposed within tracks 32 and 33 and can travel horizontally along the length of said tracks.

In the preferred embodiment, vertical hydraulic cylinders 36 (not shown in FIG. 5), disposed within telescoping vertical support columns 38, can be used to vertically position power swivel 20. Vertical hydraulic cylinders 36 can also be used to apply upward axial force to power swivel 20. Such upward axial force can be transferred downhole, typically via a tubular workstring, in order to pull cutting blades that may become stuck in a well.

Horizontal hydraulic cylinders (not shown in FIG. 5) can be used to horizontally position moveable power swivel support frame 34 and, thus, power swivel 20 relative to work deck 40. More particularly, horizontal hydraulic cylinders 37 can be used to move a power swivel (supported on power swivel support frame 34) directly over a well, and/or out of the area above such well, in order to facilitate desired operations.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An apparatus for cutting and removing pipe from a well having an upper opening comprising:

a. a deck having an upper surface and an opening extending through said deck, wherein said opening is positioned above and in substantial alignment with the upper opening of said well;

b. a frame for supporting a power swivel, wherein said frame is slidably disposed on said deck;

c. a tubular workstring having an upper end and a lower end, wherein said lower end is disposed within said well and said upper end extends from the upper opening of said well;

d. a pipe cutter disposed on said lower end of said tubular workstring;

e. a power swivel disposed on said frame for engaging said tubular workstring above said well;

f. means for moving said frame along said deck; and g. means for selectively raising and lowering said power swivel.

2. The apparatus of claim 1, wherein said means for moving said frame along said deck comprises at least one hydraulic cylinder.

3. The apparatus of claim 1, wherein said means for selectively raising and lowering said frame comprises at least one hydraulic cylinder.

4. The apparatus of claim 1, further comprising means for substantially closing said opening of said deck.

5. The apparatus of claim 4, wherein said means for substantially closing said opening of said deck comprises at least one door hingedly connected to said deck.

6. The apparatus of claim 4, wherein said means for substantially closing said opening of said deck comprises:

a. a first hinged door having a first notch; and b. a second hinged door having a second notch, wherein said first and second notches are aligned.

7. The apparatus of claim 1, further comprising a crane pole rotatably disposed on said deck.

8. The apparatus of claim 7, wherein said crane pool is positioned proximate to said opening of said deck.

9. An apparatus for cutting and removing pipe from a well having an upper opening comprising:

a. a deck having a substantially flat upper surface and an opening extending through said deck, wherein said opening is positioned above and in substantial alignment with the upper opening of said well;

b. at least one track disposed along said upper surface of said deck;

c. a frame slidably disposed on said at least one track;

d. at least one mounting bracket connected to said frame;

e. a tubular workstring having an upper end and a lower end, wherein said lower end is disposed within said well and said upper end extends from the upper opening of said well;

f. a pipe cutter disposed on said lower end of said tubular workstring;

g. a power swivel, disposed within said at least one mounting bracket, for engaging said tubular workstring above said well;

h. at least one substantially vertical hydraulic cylinder having a first end and a second end, wherein said first end of said at least one substantially vertical hydraulic cylinder is connected to said frame and said second end of said at least one substantially vertical hydraulic cylinder is connected to said at least one mounting bracket; and i. at least one substantially horizontal hydraulic cylinder having a first end and a second end, wherein said first end of said at least one substantially horizontal hydraulic cylinder is connected to said at least one track and said second end of said at least one substantially horizontal hydraulic cylinder is connected to said frame.

10. The apparatus of claim 9, further comprising means for substantially closing the opening extending through said deck.

11. The apparatus of claim 10, wherein said means for substantially closing said opening of said deck comprises at least one door hingedly connected to said deck.

12. The apparatus of claim 11, wherein said means for substantially closing said opening of said deck comprises:

a. a first hinged door having a first notch; and b. a second hinged door having a second notch, wherein said first and second notches are aligned.

13. The apparatus of claim 10, wherein said first and second notches are semicircular.

14. The apparatus of claim 9, further comprising a crane pole rotatably disposed on said deck.

15. The apparatus of claim 14, wherein said crane pole is positioned proximate to said opening of said deck.

16. A method for cutting and removing pipe from a well comprising the steps of:

a. mounting a plugging and abandonment apparatus over a well, said plugging and abandonment apparatus comprising:

i. a deck having an upper surface and an opening extending through said deck, wherein said opening is positioned above and in substantial alignment with said well;

ii. a frame for supporting a power swivel, wherein said frame is slidably disposed on said deck;

iii. a power swivel disposed on said frame;

vi. means for moving said frame along said deck; and v. means for selectively raising and lowering said power swivel;

b. conveying a cutting tool in said well on a tubular workstring;

c. sliding said frame along said at least one track until said power swivel is positioned over said well;

d. applying torque to said tubular workstring;

e. cutting a section of pipe in said well; and f. removing said section of pipe from said well.

* * * * *